US007927083B2

(12) United States Patent
Simmons

(10) Patent No.: US 7,927,083 B2
(45) Date of Patent: Apr. 19, 2011

(54) DOWNHOLE PUMP

(75) Inventor: Daniel C. Simmons, Pouce Coupe (CA)

(73) Assignees: Pentagon Optimization Services Inc., Red Deer (CA); Angel Energy Inc., Pouce Coupe (CA)

( * ) Notice: Subject to any disclaimer, the term of this patent is extended or adjusted under 35 U.S.C. 154(b) by 1038 days.

(21) Appl. No.: 10/959,166

(22) Filed: Oct. 7, 2004

(65) Prior Publication Data

US 2006/0083645 A1 Apr. 20, 2006

(51) Int. Cl.
*F04B 53/00* (2006.01)

(52) U.S. Cl. ..... 417/555.1; 417/555.2; 417/56; 417/58; 417/552; 417/904

(58) Field of Classification Search ..... 417/56–60, 417/555.1, 555.2, 904, 552; 166/335, 385
See application file for complete search history.

(56) References Cited

U.S. PATENT DOCUMENTS

| | | | | | |
|---|---|---|---|---|---|
| 2,455,084 | A * | 11/1948 | Neely | 417/511 |
| 3,295,453 | A * | 1/1967 | Scott | 417/403 |
| 4,519,753 | A * | 5/1985 | Kitsnik | 417/403 |
| 4,602,684 | A * | 7/1986 | Van Wormer et al. | 166/285 |
| 4,688,999 | A * | 8/1987 | Ames et al. | 417/550 |
| 4,861,239 | A * | 8/1989 | Simmons et al. | 417/383 |
| 4,871,302 | A * | 10/1989 | Clardy et al. | 417/404 |
| 5,372,488 | A * | 12/1994 | Turner | 417/554 |
| 5,411,381 | A * | 5/1995 | Perrodin | 417/472 |
| 5,718,564 | A * | 2/1998 | Nocchi | 417/44.2 |
| 6,039,544 | A | 3/2000 | Strickland | |
| 2002/0108757 | A1 * | 8/2002 | Traylor | 166/384 |
| 2003/0034161 | A1 * | 2/2003 | Rice | 166/369 |

FOREIGN PATENT DOCUMENTS

| | | |
|---|---|---|
| CA | 466781 | 7/1950 |
| CA | 1203749 | 4/1986 |
| CA | 1203749 B1 | 4/1986 |

* cited by examiner

*Primary Examiner* — Devon C Kramer
*Assistant Examiner* — Christopher Bobish
(74) *Attorney, Agent, or Firm* — Oyen Wiggs Green & Mutala LLP

(57) ABSTRACT

An apparatus and method for pumping from a well. A pump includes a piston assembly reciprocably engaged in a cylinder assembly. Pressure applied to a column of fluid above the pump causes a pump chamber to fill with fluid. A spring mechanism coupled to an anchor point above the piston assembly provides upward force on the piston assembly. Alternate cycles of the application and release of pressure result in the pumping of a fluid.

61 Claims, 8 Drawing Sheets

DOWNHOLE PUMP

TECHNICAL FIELD

This invention relates to pumps and, more specifically, pumps which can be efficiently operated at significant depths. Specific embodiments of this invention have application in dewatering gas wells and pumping oil from oil wells. Pumps according to the invention may also be used in water wells.

BACKGROUND

Natural gas is collected in gas wells which intersect with gas-bearing formations. If water in a gas well rises to a level above a gas-bearing formation or collects in a tubing or casing, then the water can interfere with the efficient collection of natural gas. It is therefore necessary to provide a means to remove water from the well.

In the production of coal bed methane, it is necessary to pump water from a well in order to decrease the head of water in a coal seam to just below the top of the seam. Removal of water releases the pressure holding the gas in the coal seam. This frees the gas so that it can be extracted.

Pump jacks are often used to remove water from gas wells. A pump jack is a device located at the surface which reciprocates a pump rod by rotation of a crank driven by a motor. The motor rotates a counter-weighted crank, thereby causing a beam to move up and down. The beam drives a pump rod, which extends to a pump located in the well bore at or above or below the gas bearing formation, thereby operating the pump. Although common, pump jacks are bulky and expensive to use. Additionally, they are prone to gas lock during operation.

Soberg, Canadian patent No. 466,781 discloses a deep well pump. A pump cylinder contains a hollow piston adapted to be reciprocated by variation of the static pressure of a liquid column above the piston. Downward movement of the hollow piston is provided by an increase in pressure above the liquid. This drives liquid into the hollow piston, compressing a body of gas. The pressure on the liquid above the piston is then decreased. The piston then rises under the influence of a suitable spring or metal bellows positioned beneath the cylinder. This pump requires an air chamber within the cylinder, which limits the liquid-pumping capacity of the pump.

Canalizo, Canadian patent No. 1,203,749 discloses a second design for a deep well pump. This pump uses a power piston and a production piston that are rigidly interconnected. A hydraulic fluid acting on the power piston moves the power piston downward, causing a production cylinder to fill with fluid. When the hydraulic force on the power piston fluid is removed, both pistons are moved in the opposite direction, either by using a power fluid of lesser density than the production fluid, or by isolating the hydrostatic head of fluid in the tubing from the production cylinder so that the production cylinder is subjected to bottom hole pressure that is less than the tubing pressure at the pump.

There remains a need for reliable and cost effective apparatus and methods for pumping in deep wells.

SUMMARY OF THE INVENTION

This invention provides pumps capable of operating in gas wells and other downhole applications. The pumps are operated by fluid pressure. In preferred embodiments the pumps are operated by varying the pressure of a fluid being pumped.

One aspect of the invention provides pumps adapted to be used in a tubing in a well. The pumps comprise: a piston assembly reciprocably engaged in a cylinder assembly. The piston assembly comprises a first piston coupled to a second piston. The second piston has a larger cross-sectional area than the cross-sectional area of the first piston. A pumping chamber is defined by the piston assembly and the cylinder assembly. A first means is provided for biasing the piston assembly in a first direction. The first means for biasing the piston assembly in a first direction extends between the piston assembly and an anchor point located outward of the piston assembly. The piston assembly may be moved in a second direction, which is opposite the first direction, by increasing the pressure of a fluid in the tubing against the first piston. The pressure may be increased by introducing a first volume of fluid into the tubing. A second volume of fluid is expelled from the pumping chamber when the piston assembly moves in the first direction. The second volume of fluid is larger than the first volume of fluid. The first direction may be upward and the second direction may be downward. The anchor point may be above the piston assembly.

The anchor point may be located at substantially the surface of the well, for example, above the top of a casing of the well.

The first means for biasing the piston assembly in a first direction may comprise an elastically stretchable wire, which may be stretchable the length of a stroke of the piston assembly. In some embodiments, the length of the stroke is in the range of approximately 5 feet to 15 feet. In some embodiments the elastically stretchable wire is at least 500 feet long. In some embodiments the first means for biasing the piston assembly in a first direction comprises a coil spring, a Belleville spring pack, or the like.

The pumps may also include, extending between the piston assembly and a point inward in the well of the piston assembly, a second means for biasing the piston assembly in the first direction. The second means may include, for example, a Belleville spring pack, a pneumatic spring or a hydraulic force multiplier.

The second piston may comprise at least one one-way valve in a path of fluid communication between the pumping chamber and a space in the tubing which is inward of the piston assembly, the at least one one-way valve of the second piston allows fluid to flow into the pumping chamber. The cylinder assembly may comprise at least one one-way valve in a path of fluid communication between the pumping chamber and a space in the tubing which is outward of the cylinder assembly, the at least one one-way valve of the cylinder assembly allows fluid to flow only out of the pumping chamber to the space of the tubing which is outward of the cylinder assembly. The second piston may comprise at least one one-way valve in a path of fluid communication between the pumping chamber and a space in the tubing which is inward of the cylinder assembly. The first piston may include a hollow portion having at least one one-way valve in a path of fluid communication between the pumping chamber and a space in the tubing which is outward of the cylinder assembly, the at least one one-way valve of the first piston allows fluid to flow only out of the pumping chamber to the space of the tubing which is outward of the cylinder assembly, the fluid being expelled from the pumping chamber through the hollow portion.

In some embodiments, the space in the tubing which is inward of the cylinder assembly may be below the cylinder assembly and the space in the tubing which is outward of the cylinder assembly may be above the cylinder assembly.

According to another aspect, the invention provides for pumping systems comprising a pump according to the invention and means for varying the pressure of the fluid in the tubing against the first piston. The means for varying the pressure of the fluid against the first piston may include a pump or other pressure source connected to introduce fluid into the tubing to increase the pressure against the first piston and a control valve in fluid communication with the tubing which may be opened to permit fluid to be removed from the tubing to decrease the pressure against the first piston. The pressure source may comprise a pneumatic pump, a motor-driven pump, an electric pump, a high pressure pipeline or a gas compressor, or the like. The pressure source may be located at the surface of the well.

The pumping system may be adapted for many types of applications, including for use in gas wells, wherein gas is permitted to flow in a well casing in the first direction, for use in dewatering coal beds to facilitate extraction of coal bed methane, and for use in an oil well, wherein the production fluid is pumped up the tubing.

The pumping systems may include means for preventing fluid from passing from the tubing into the casing in the event that the pump fails.

The pumping systems may include a sealing apparatus which is slidable between a first position which is open to allow fluid to enter the tubing from the well below the pump, and a second position which is closed to prevent liquid from escaping from the tubing into the well. The cylinder assembly may include a downwardly projecting member that displaces the sealing apparatus downwardly to hold the sealing apparatus in the first, open, position during normal operation of the pump. The sealing apparatus may comprise a spring loaded sleeve, a spring-loaded ball or a plunger.

The pumping systems may include a fluid reservoir in fluid communication with the pressure source, the fluid reservoir containing the fluid to be introduced into the tubing by the pressure source. The control valve may be in fluid communication with the fluid reservoir. The fluid removed from the tubing and flowing through the control valve may be deposited in the fluid reservoir. The fluid reservoir may have an outlet for removing excess fluid from the fluid reservoir.

The pumping systems may include means for opening and closing the control valve and means for monitoring the pressure of the fluid in the tubing against the first piston, the means for monitoring the pressure of the fluid in the tubing against the first piston being in communication with the means for opening and closing the control valve, whereby the control valve is opened and closed according to the pressure of the fluid in the tubing against the first piston. The means for monitoring the pressure of the fluid in the tubing against the first piston may include one or more of: means for monitoring the tension in the first means for biasing the piston assembly in a first direction, means for monitoring the cycle time of the pump, means for monitoring the fluid discharge rate of the pump and means for monitoring the rate of any gas flowing out of the well.

According to another aspect, the invention provides pumping apparatus for use in a tubing in a well. The pumping apparatus comprise a piston assembly reciprocably engaged within a cylinder assembly, means for applying a force in a first direction to the piston assembly, the means for applying a force in a first direction to the piston assembly extending between the piston assembly and an anchor point located proximal of the piston assembly, and means for causing the pressure of a column of fluid within the tubing against the first piston to vary in order to alternately apply and release a force on the piston assembly in the first direction.

According to yet another aspect, the invention provides methods for pumping fluid from a well. The methods include providing a pump according to the invention in a well, varying the pressure of a fluid in the tubing against the first piston, wherein increasing the pressure of fluid against the first piston allows the piston assembly to move in a second direction which is opposite the first direction, thereby allowing fluid to enter the pumping chamber, and wherein reducing the pressure of the fluid against the first piston causes the piston assembly to move in the first direction thereby expelling fluid from the pumping chamber, wherein the pressure of the fluid against the first piston is increased by introducing a first volume of fluid into the tubing, and a second volume of fluid is expelled from the pumping chamber when the piston assembly moves in the first direction, the second volume of fluid being larger than the first volume of fluid.

The methods may include monitoring the pressure of the fluid in the tubing against the first piston and adjusting the pressure against the first piston in order to vary the pressure of the fluid in the tubing against the first piston. Monitoring the pressure of the fluid in the tubing against the first piston may include monitoring one or more of: the tension in the first means for biasing the piston assembly in the first direction, the cycle time of the pump, the fluid discharge rate of the pump and the rate of any gas flowing out of the well.

The pressure of the fluid in the tubing against the first piston may be decreased by opening a control valve in fluid communication with the tubing thereby permitting fluid to be removed from the tubing. The first means for biasing the piston assembly in the first direction may comprise an elastically stretchable wire, and the methods may also include monitoring and adjusting the tension and length of a wire.

Further aspects of the invention and features of embodiments of the invention are set out below.

BRIEF DESCRIPTION OF DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
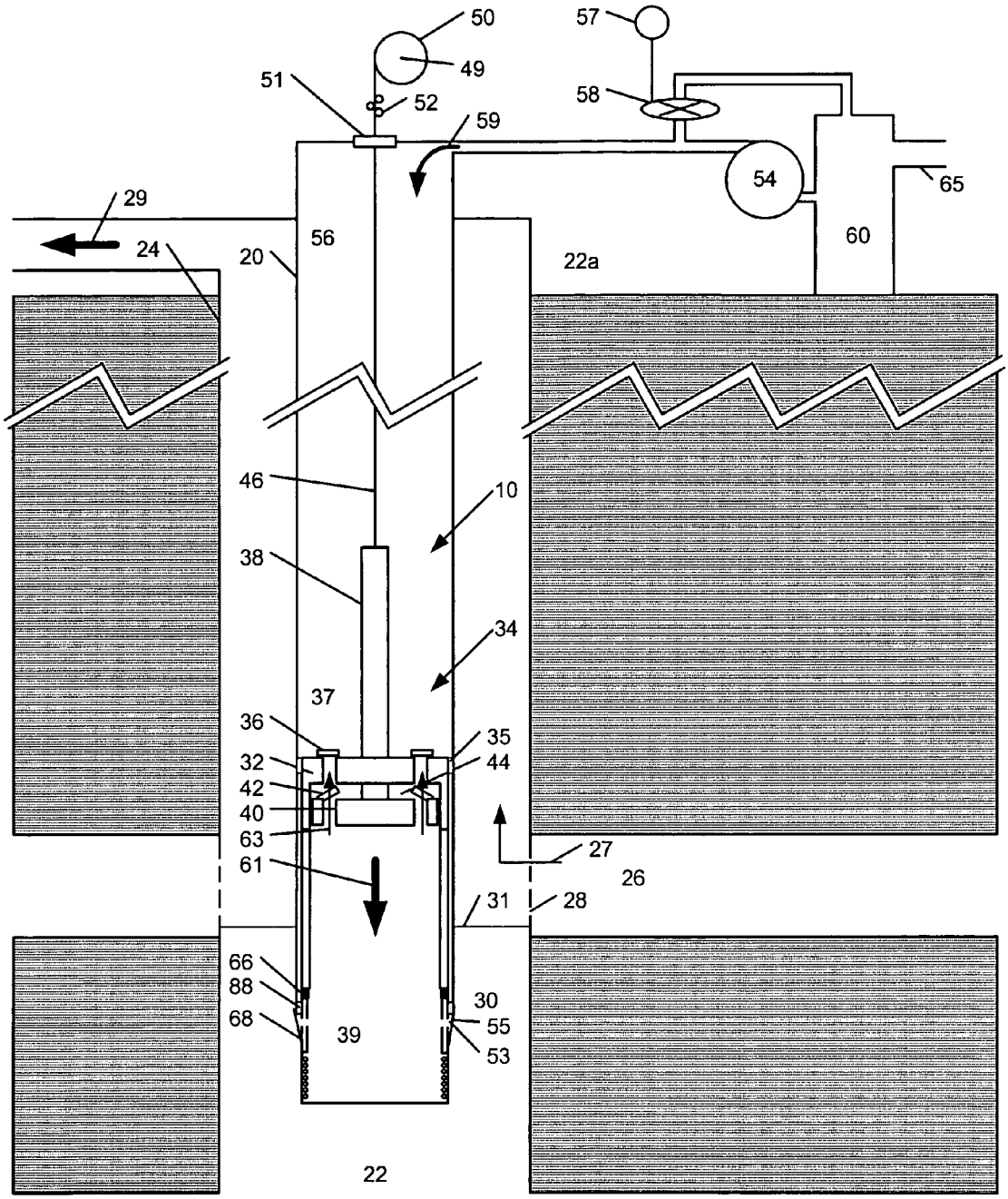
FIG. 1 is a schematic diagram of a pump in a gas well representing one embodiment of this invention at the top of the pumping cycle.

FIG. 1 shows a gas well 22. Well 22 is of sufficient depth to reach a gas-producing stratum, represented in the figures by a gas zone 26, or a seam of coal. Well 22 may be deep, for example 500 feet to 10,000 feet or more in some instances. A typical depth for a well 22 in which this invention can be most effectively applied is, for example, 6,000 feet. The term "deep well" is used herein to mean a well having a depth of at least 500 feet. The break lines shown in the drawings indicate that the depths of the wells shown in the drawings are not to scale.

Well 22 includes a casing 24, within which is contained a tubing 20. Gas from gas zone 26 enters casing 24 through perforations 28. Water and/or hydrocarbon liquids 30 also enter casing 24 through perforations 28 along with gas 26 as a mixture in mist form. As used herein, the term water refers to both water and/or hydrocarbon liquids, which may be for example condensate or oil. Once inside casing 24, gas 26 tends to separate and flow upwards, while water 30 remains behind unless well formation 22 has enough pressure to induce sufficient velocity to carry the liquids up casing 24 with the gas, termed the critical lift rate. Water 30 tends to rise within casing 24 to a level 31. The flow of gas 26 up casing 24 will be inhibited whenever the water level is above gas zone 26. If it is desired that the gas 26 flow up casing 24 when well 22 lacks sufficient pressure to achieve the critical lift rate, it is therefore necessary to provide a means for pumping water 30 up to the surface 22*a* of the well and out of well 22 at a sufficient rate to maintain water level 31 in casing 24 below the level of perforations 28.

A pump 10 pumps water 30 up tubing 20, thereby allowing gas from gas zone 26 to flow freely up casing 24 as indicated by arrow 27. Gas is collected at the top of casing 24, as indicated by arrow 29. Pump 10 has a piston assembly 34 which is reciprocably engaged in a cylinder assembly 32. Cylinder assembly 32 is positioned at an appropriate depth within well 22 to enable it to pump water 30 upward within tubing 20, thereby maintaining water level 31 below the level of perforations 28. Cylinder assembly 32 has a seal 35 positioned between cylinder assembly 32 and tubing 20 to prevent the flow of liquid past cylinder assembly 32. Cylinder assembly 32 may comprise, for example, a chrome cylinder with finite or no-gap Teflon™ piston rings. In the illustrated embodiment, cylinder assembly 32 is held in position by the weight of the column of fluid 56 above cylinder assembly 32 in tubing 20.

Cylinder assembly 32 and piston assembly 34 define a pumping chamber 44. Pumping chamber 44 may also be provided by use of a bellows or diaphragm, but is preferably provided by cylinder assembly 32 and piston assembly 34 as described herein. Reciprocation of piston assembly 34 within cylinder assembly 32 causes pumping chamber 44 to expand and contract. Cylinder assembly 32 has at least one one-way discharge valve assembly 36 in a path of fluid communication extending between a space 37, which is located in tubing 20 above cylinder assembly 32, and pumping chamber 44. Contraction of pumping chamber 44 thus forces water from within pumping chamber 44 into space 37. Any suitable mechanism permitting liquid to flow only in the direction from pumping chamber 44 to space 37 may be used for discharge valve assembly 36.

Piston assembly 34 comprises a first piston 38 coupled to a second piston 40. Piston 38 and piston 40 may be integral with one another (i.e. piston assembly 34 may be a single integrally formed part) and could alternatively be separate elements which are coupled to one another, directly or indirectly, by any suitable means. Second piston 40 has a larger cross-sectional area than first piston 38. In the illustrated embodiment, pistons 38 and 40 (and tubing 20) each have a circular cross-section. Second piston 40 thus has a larger diameter than first piston 38 and, for convenience, the terms "small-diameter piston 38" and "large-diameter piston 40" are used herein. However, it will be appreciated that it is not necessary for pistons 38 and 40 and tubing 20 to have circular cross-sections. Other cross-sectional profiles are possible and within the scope of this invention.

The relative sizes of small-diameter piston 38 and large-diameter piston 40 are important. Sizing the cross-sectional areas correctly minimizes the pressure differential required to cycle pump 10. Further, if the cross-sectional area of small-diameter piston 38 is too small, the hydraulic force required to move it may exceed the tubing limit. The cross-sectional areas of small-diameter piston 38 may for example be sized to operate at a maximum of 5000 PSI; however, use of tubing 20 with a higher pressure rating may allow use of a small-diameter piston 38 sized to operate at higher pressures. The differential pressure required for the stroke of downhole pump 10 varies with the relative sizes of small-diameter piston 38 and large-diameter piston 40, and seal friction. Downhole pump 10 may, for example, cycle every 15 minutes at approximately 800 PSI Differential Pressure to move 1 BBL of fluid per day.

Piston assembly 34 has at least one one-way inlet valve assembly 42, which is in a path of fluid communication extending between a space 39 located below piston assembly 34 and pumping chamber 44. In the illustrated embodiment, inlet valve assembly 42 is located on large-diameter piston 40. Inlet valve assembly 42 could also be located on the side of cylinder assembly 32. Any suitable mechanism permitting liquid to flow only in the direction from space 39 to pumping chamber 44 may be used for inlet valve assembly 42.

The illustrated embodiment shows a vertically oriented well, and thus space 37 has been described herein as being "above" cylinder assembly 32 and space 39 has been described as being "below" piston assembly 34. These and other similar directional terms are used as a matter of convenience and should not be interpreted narrowly. It is to be understood that the present invention is not restricted to apparatuses and methods involving, or for use in, only vertically-oriented wells, but also includes apparatuses and methods involving or for use in wells of other orientations such as angled or horizontal orientations.

As used herein (including in the claims) the words "outward" and "inward" refer to the relative positions of two elements or spaces in relation to the surface 22*a* of the well 22. That is, a first element (or space) is "outward" of a second element (or space) where the first element (or space) is nearer to surface 22*a* than the second element (or space). For example, space 37 is outward of cylinder assembly 32 because it is nearer to surface 22*a* than cylinder assembly 32. Similarly, one element (or space) is "inward" of another element (or space) where it is farther from surface 22*a* than the other element (or space). For example, space 39 is inward of piston assembly 34 as it is farther from surface 22*a* of the well than piston assembly 34.

Pump 10 includes a first means for biasing piston assembly 34 in a first direction. In the illustrated embodiment, the first direction is upward as the well is vertical, but as noted, the well need not be vertical and thus the first direction can, but need not necessarily be, upward. The first means for biasing piston assembly in a first direction comprises a member extending between piston assembly 34 and an anchor point 49 located outward of the piston assembly. In the illustrated embodiment, anchor point is located above the height reached by the top of piston assembly 34 at the top of the pumping cycle. In some embodiments, anchor point 49 is located substantially at the surface of well 22. "Substantially at the surface of well 22" means being positioned at or above the surface or within well 22 at a depth no greater than 10% of the total depth of well 22. In some embodiments, anchor point 49 is located above the top of casing 24.

In the illustrated embodiment, the first means for biasing piston assembly 34 in the first direction comprises an extension spring, which may be a spring wire 46. Spring wire 46 applies upward force to piston assembly 34. Any suitable elastically stretchable material may be used for spring wire 46. Spring wire 46 may preferably be made from, for example, chrome silicon wire at ⅜ inch diameter or 3/16 inch stainless steel slickline, which can be elastically stretched by, for example, approximately 1 metre per 1000 metres of length. Spring wire 46 may also comprise nylon rope or material like a heavy guitar string. Spring wire 46 should be capable of elastically stretching by the length of the pump stroke. In some embodiments of this invention the pump stroke has a length in the range of about 5 feet to 15 feet.

In the illustrated embodiment, spring wire 46 is coupled to the upper end of small-diameter piston 38. Spring wire 46 is also coupled to anchor point 49. In the illustrated embodiment, an adjusting winch 50 is located at anchor point 49, which is located above the top of casing 24. Adjusting winch 50 is used to regulate the position of downhole pump 10 in well 22, and to regulate the tension in spring wire 46. A seal 51 seals between connecting wire 48 and tubing 20 to prevent fluid leaking out when pressure is applied to column of fluid 56.

A tension indicator may be used in conjunction with downhole pump 10 to indicate that an appropriate level of tension is being applied to spring wire 46. The tension indicator is preferably located at the surface 22*a* to facilitate monitoring the tension in spring wire 46, and it may be connected to adjusting winch 50. In the embodiment illustrated in FIG. 1, a weight indicator 52 functions as a tension indicator. Weight indicator 52 may comprise, for example, a series of three pulleys positioned so as to cause a small bend in the wire, with a weight indicator connected to measure a force exerted by the wire on the central pulley.

A pressure source 54 located at the surface 22*a* of well 22 is used in combination with a control valve 58 to alternately apply pressure to and release pressure from a column of fluid 56 in tubing 20. Pressure source 54 may comprise, for example a high-pressure pipeline, compressor discharge gas, an electrical pump, or a motor-driven pump. Pressure source 54 is preferably a pneumatic pump.

Control valve 58 is opened and closed to regulate the pumping cycle by a control mechanism 57. Control mechanism 57 may, for example, comprise a computer or programmable controller which operates an actuator coupled to operate control valve 58. Control mechanism 57 could for example operate by sensing the tension in spring wire 46. Control mechanism 57 could also monitor the cycle time, gas flow rate, or the discharge rate of downhole pump 10 to determine if the pumping rate is too high, too low, or if downhole pump 10 has failed.

The column of fluid 56 may be initially provided by pumping fluid into tubing 20 from the surface with no tension in spring wire 46. The fluid used in column of fluid 56 preferably has the same specific gravity as the production fluid of well 22. Column of fluid 56 may be liquid, gas, or a combination of liquid and gas. Column of fluid 56 functions as the power transmitting fluid to transmit the pressure generated by pressure source 54 to small-diameter piston 38. The discharge fluid from downhole pump 10 therefore serves as the power transmitting fluid to operate downhole pump 10.

Spring wire 46 is adjusted to the appropriate tension by gradually increasing the tension until piston assembly 34 moves upwards. At this point, there is no increase in the tension in spring wire 46 as piston assembly 34 moves upward. Once piston assembly 34 is at the top of its stroke, tension begins to increase again, and downhole pump 10 is prepared for use. The spring tension in spring wire 46 is preferably high enough to move piston assembly 34 to the top of its stroke against the pressure exerted on small-diameter piston 38 by the weight of column of fluid 56, but not significantly.

To operate downhole pump 10, pressure source 54 pumps fluid into the column of fluid 56. When control valve 58 is in the closed position, pressurized fluid, which may be liquid or gas, from pressure source 54 enters the column of fluid 56 as indicated by arrow 59. This increases the pressure in column of fluid 56. Release of the pressure on column of fluid 56 is achieved by opening control valve 58 to allow fluid to enter a fluid reservoir 60. Pressure source 54 may continue to pump when control valve 58 is open, or its operation may be stopped.

FIG. 1 shows downhole pump 10 at the top of its pumping cycle. To operate downhole pump 10, column of fluid 56 is pressurized by operating pressure source 54 while control valve 58 is closed. The pressure in column of fluid 56 increases upon the introduction of fluid into tubing 20 by pressure source 54. This increases the net force acting on small-diameter piston 38, causing piston assembly 34 to move in a second direction, as indicated by arrow 61. The second direction is opposite the first direction. In the illustrated embodiment, with a vertical well, the second direction is downward. Again, the invention can be practiced in wells having orientations other than vertical, meaning that the second direction may, but need not necessarily, be downward.

Advantageously, in some embodiments of the invention, pumping chamber 44 is reduced to substantially zero volume when piston assembly 32 is at the top of its stroke. Providing such zero clearance between the top of larger diameter piston 40 and cylinder assembly 32 permits gas to be effectively expelled from pumping chamber 44 and reduces the possibility that trapped gases could cause a "gas lock".

Pressure in column of fluid 56 applies a downward force to the top of small-diameter piston 38. As piston assembly 34 moves downward relative to cylinder assembly 32, water 30 enters pumping chamber 44 via inlet valve assembly 42, as indicated by arrows 63.

Figure 2:
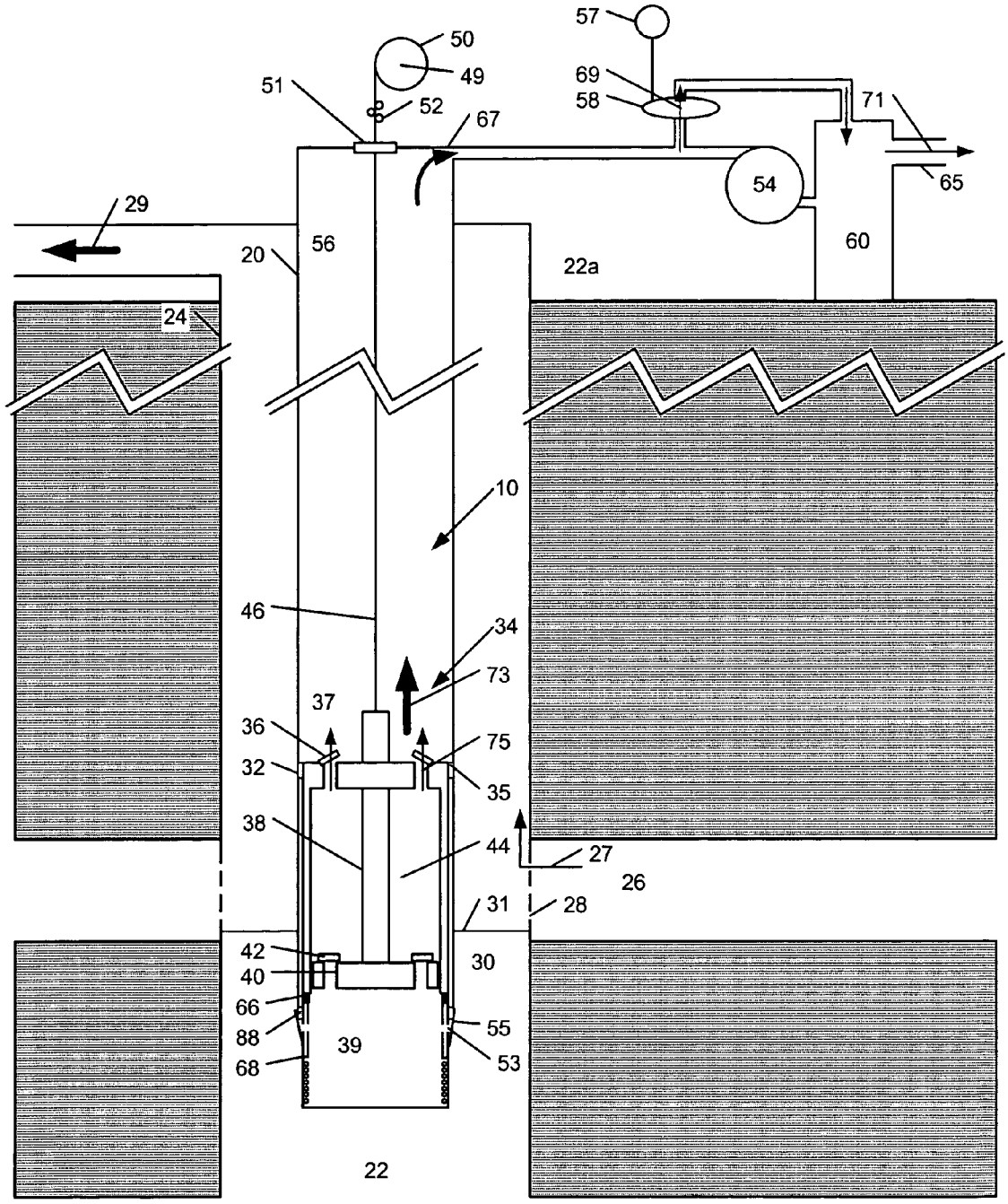
FIG. 2 is a schematic diagram of the pump of FIG. 1 in a gas well at the bottom of the pumping cycle.

FIG. 2 shows downhole pump 10 at the bottom of its pumping cycle. To return downhole pump 10 to the top of its cycle, control valve 58 releases the pressure in column of fluid 56. Control valve 58 is open in FIG. 2. The release of pressure within column of fluid 56 reduces the downward force on small-diameter piston 38. This permits spring wire 46 to move piston assembly 34 in an upward direction relative to cylinder assembly 32, as shown by arrow 73. The resulting compression of pumping chamber 44 causes the fluid contained therein to be expelled through outlet valve assembly 36 into space 37, as indicated by arrows 75. Downhole pump 10 is thereby returned to the top of its pumping cycle. As downhole pump 10 returns to the top of its cycle, fluid from the column of fluid 56 enters a fluid reservoir 60 as indicated by arrows 67 and 69. A discharge outlet 65 removes excess fluid from the system as shown by arrow 71.

It will be appreciated that there will be a net flow of fluid out of tube 20 in the pumping cycle of pump 10. This results from the difference in cross-sectional areas between small-diameter piston 38 and large-diameter piston 40. In other words, the volume of fluid expelled from the tube 20 during the up stroke of pump 10 will exceed the volume of fluid introduced into tube 20 during the down stroke of pump 10. This can be appreciated with reference to FIGS. 1 and 2.

In particular, FIG. 1 illustrates the pump 10 at the top of the pumping cycle and FIG. 2 illustrates the pump 10 at the bottom of the pumping cycle. A first volume of fluid is introduced into tube 20 (via pressure source 54) during the down stroke of pump 10 as explained above. The first volume of fluid is equivalent to the volume of the portion of the small-diameter piston 38 which is displaced downwardly during the downward movement of the piston assembly 34 during the down stroke (plus a small amount to compensate for any expansion of tubing 20 and for compression of any gas entrained in column of fluid 56 resulting from the increased pressure resulting from the introduction of fluid into tube 20). This can be seen by comparing how much of the small-diameter piston 38 is above the top of cylinder assembly 32 at the top of the pumping cycle, as shown in FIG. 1, relative to the bottom of the pumping cycle, as shown in FIG. 2. On the other hand, a second volume of fluid is expelled from tube 20 during the up stroke. The second volume of fluid is equivalent to the volume of the expanded pump chamber 44 shown in FIG. 2. This volume of fluid is expelled through one-way discharge valve 36 during the up stroke, causing an equivalent volume of fluid to be expelled from column of fluid 56 in tube 20 and into reservoir 60 and/or discharged from the system through discharge outlet 65, as explained above. Since the cross-sectional area of large-diameter piston 40 is greater than the cross-sectional area of small-diameter piston 38, the second volume of fluid (i.e. that which is expelled from tube 20 during the up stroke) is greater than the first volume of fluid (i.e. that which is introduced into tube 20 during the down stroke), resulting in a net flow of fluid out of tube 20 during each pumping cycle of pump 10.

Downhole pump 10 may also include a spring-loaded sleeve 68, which is a device known to those skilled in the art. Spring-loaded sleeve 68 is sealed in tubing 20 by seals 88. Spring-loaded sleeve 68 is displaced downwardly when downhole pump 10 is located at the appropriate depth within gas well 22. The weight of the column of fluid 56 holds downhole pump 10 in position. A member 66 projecting downward from cylinder assembly 32 pushes sleeve 68 downward into its open position when downhole pump 10 is at the operating depth. This creates an opening 53 which allows water to enter tubing 20. If downhole pump 10 fails or leaks, water from column of fluid 56 will leak down past cylinder assembly 32, thereby reducing the force applied to downhole pump 10 by column of fluid 56.

Figure 3:
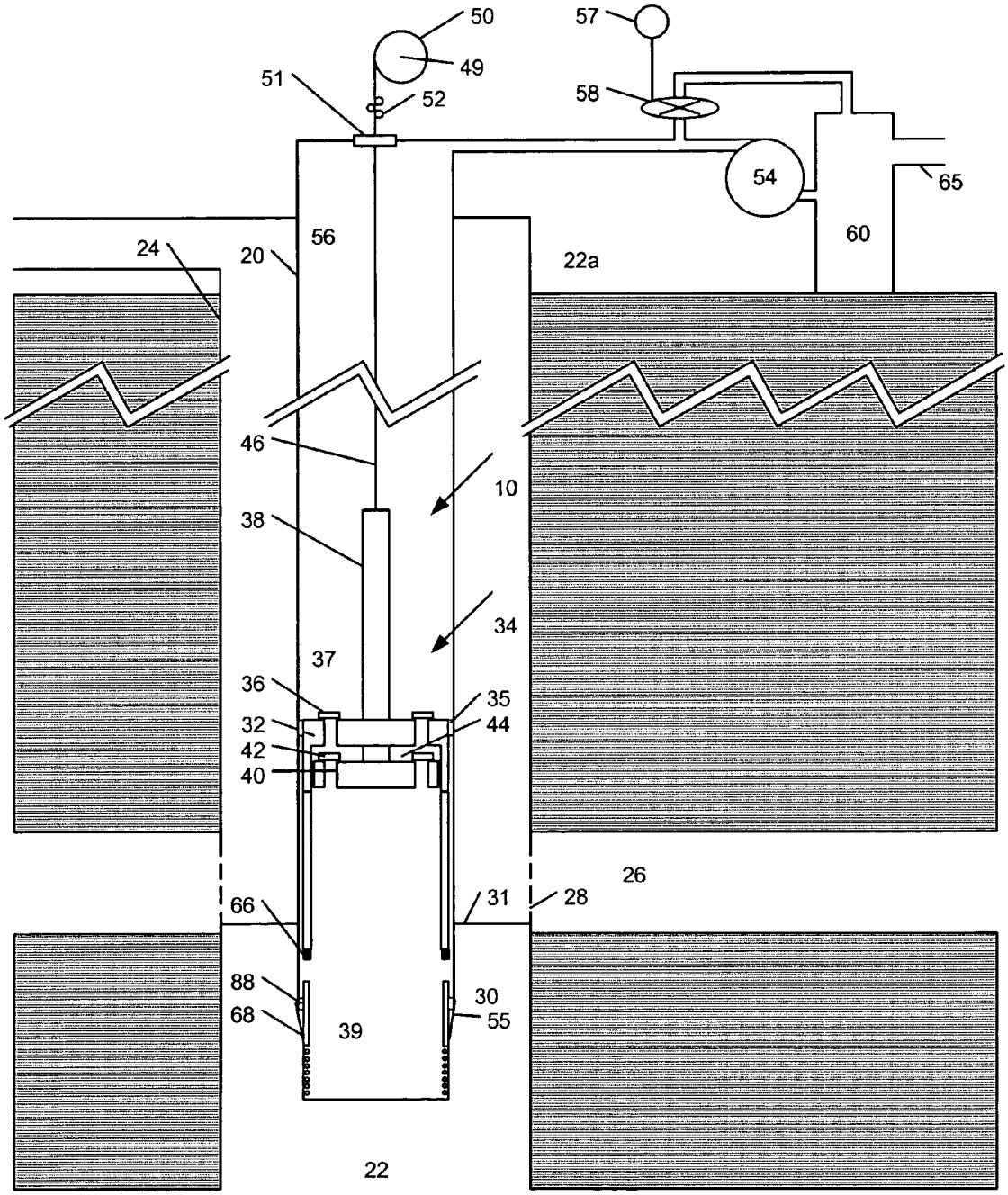
FIG. 3 is a schematic diagram illustrating how a spring loaded sleeve functions if the downhole pump fails or leaks.

Eventually, if the leaking continues, the upward force applied by spring wire 46 will pull both piston assembly 34 and cylinder assembly 32 up within tubing 20. This result is shown in FIG. 3. As a result of the upward movement of downhole pump 10, spring-loaded sleeve 68 is no longer displaced downwardly by cylinder assembly 32. This results in the elimination of opening 53, and closes off the lower end of tubing 20. Sleeve 68 thereby prevents fluid from leaking from within tubing 20 into casing 24. The function of spring-loaded sleeve 68 may also be performed by a spring-loaded ball or a plunger, which are devices known to those skilled in the art. Any other similar device wherein a sealing mechanism is displaced by downhole pump 10 to allow fluid to enter tubing 20, but which seals if downhole pump 10 moves upward within tubing 20, may also be used in place of spring-loaded sleeve 68. A check valve, also a device known to those skilled in the art, should not be used in place of spring-loaded sleeve 68 because there is always reverse flow at the suction side of downhole pump 10. The presence of continuous reverse flow allows the use of a good suction screen 55 positioned at the fluid intake of downhole pump 10, which is constantly being purged by the reverse flow.

Figure 4:
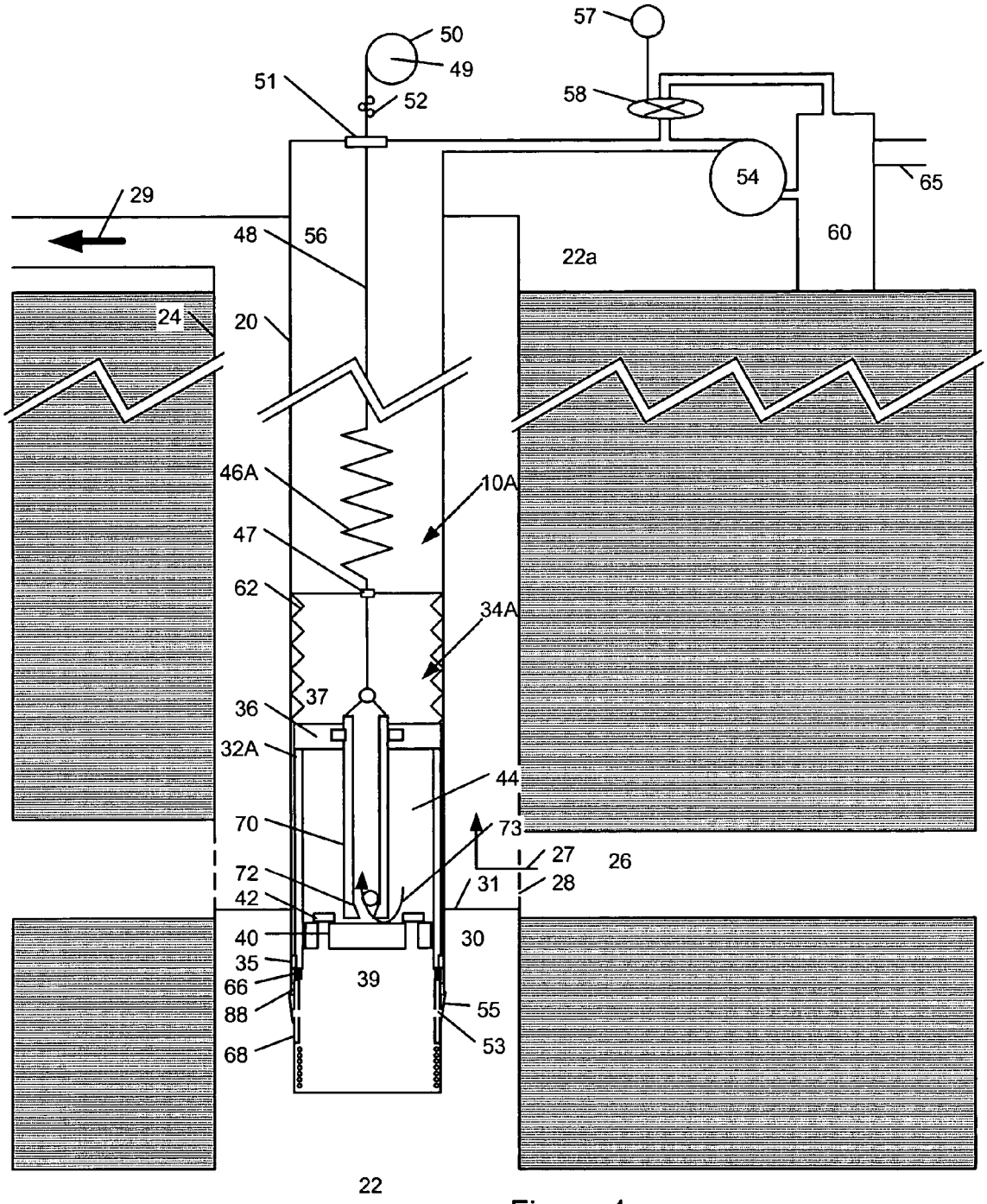
FIG. 4 is a schematic illustration of pump in a gas well according to a second embodiment of the invention.

A downhole pump 10A representing another embodiment of this invention is shown at the bottom of its pumping cycle in FIG. 4. Downhole pump 10A is similar to downhole pump 10, except that the upward bias is provided by a coil spring 46A. Coil spring 46A could be replaced by or augmented with a Belleville spring pack or any other elastically stretchable unit providing a sufficient degree of extension. Coil spring 46A is coupled via a connecting wire 48 to anchor point 49. Coil spring 46A is preferably located near the top of piston assembly 34A in order to minimize the movement of connecting wire 48.

The first means to bias the piston assembly in the first direction may include a spring to provide additional upward force on piston assembly 34A. In the embodiment illustrated in FIG. 4, the spring comprises a Belleville spring pack 62. A coil spring may alternatively be used alone or in combination with a Belleville spring pack. Belleville spring pack 62 is coupled to both cylinder assembly 32A and the spring wire 46A. Belleville spring pack 62 may be coupled to spring wire 46A by a clamp 47 or other suitable mechanism. Belleville spring pack 62 is compressed on the downstroke of the pump, and functions to pull a pump plunger 70 upward upon the release of hydrostatic pressure within tubing 20 by augmenting the force provided by spring wire 46A.

In downhole pump 10A, small-diameter piston 38 has been replaced by a hollow pump plunger 70. Pump plunger 70 is hollow so as to allow fluid to flow through it. Pump plunger 70 includes at least one one-way discharge valve 72 in a path of fluid communication between space 37 and pumping chamber 44. Water exits pumping chamber 44 through discharge valve 72, thereby passing through pump plunger 70. Any suitable valve mechanism allowing only the one-way flow of water from pumping chamber 44 to space 37 may be used for discharge valve 72.

The operation of downhole pump 10A is essentially as described above. Upon pressure source 54 pressurizing column of fluid 56, a downward force is applied to pump plunger 70. This forces piston assembly 34A downward, causing water to enter pumping chamber 44 through inlet valve assembly 42 in the large-diameter piston 40. At the bottom of the stroke, pressure in column of fluid 56 is released by control valve 58, allowing coil spring 46A and Belleville spring pack 62 to pull piston assembly 34A upward. When large-diameter piston 40 moves upward within cylinder assembly 32A, water within pumping chamber 44 is forced through discharge valve 72 into space 37, as indicated by arrow 73. Downhole pump 10A is thereby returned to the top of the pumping cycle.

Figure 5:
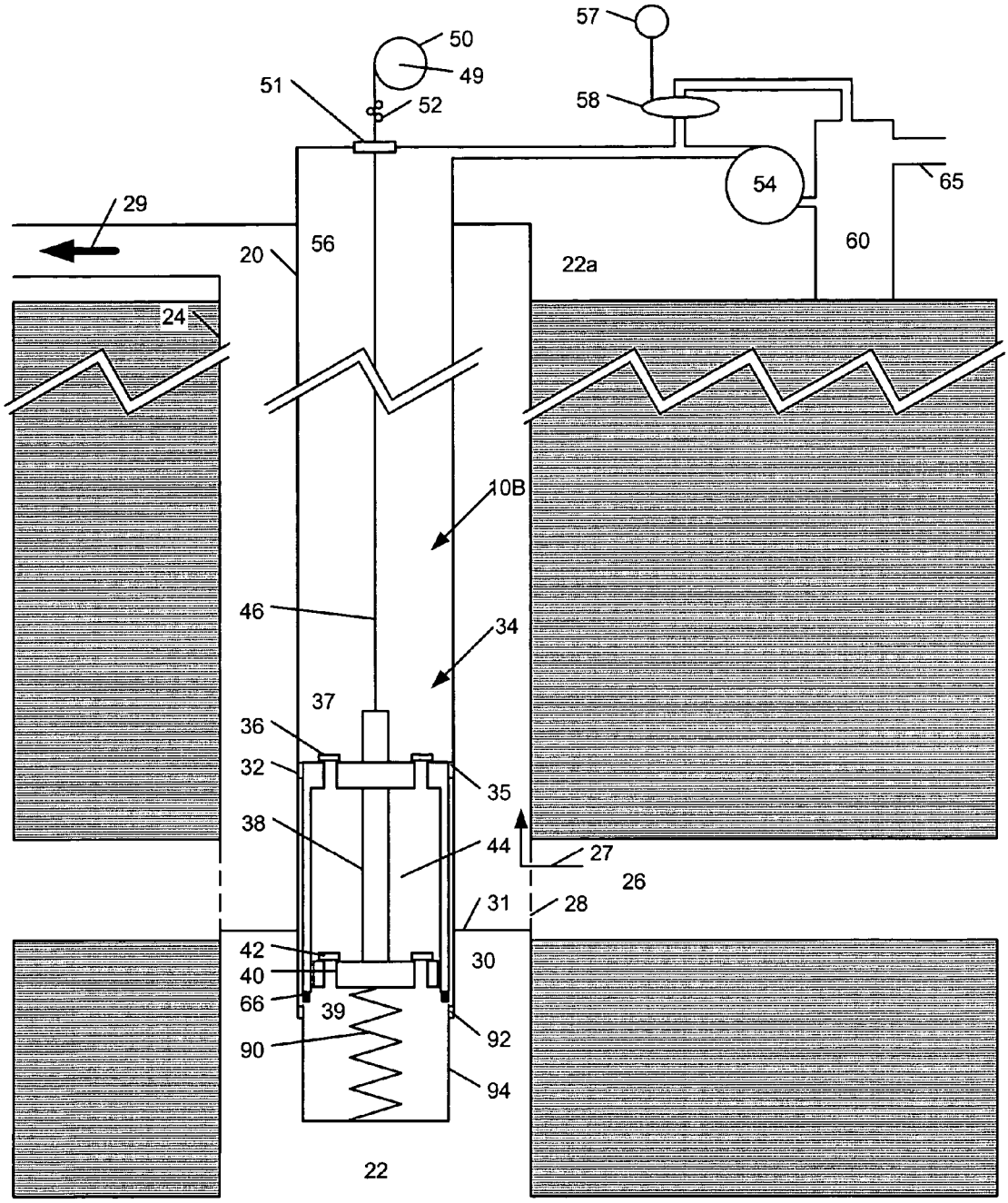
FIG. 5 is a schematic diagram of a downhole pump according to a third embodiment of this invention. This embodiment includes an auxiliary spring positioned below the downhole pump.

A pump representing another embodiment of this invention is shown as downhole pump 10B in FIG. 5. In this embodiment, a second means for biasing the piston assembly 34 in the first direction is included. The second means for biasing the piston assembly in the first direction extends between the piston assembly 34 and a point inward of the piston assembly. In the illustrated embodiment, the second means comprises spring 90, which is positioned below piston assembly 34, and provides additional upward bias beyond that produced by spring wire 46. Spring 90 is held in position by a support apparatus 94, which is anchored within tubing 20 by a sealing mechanism 92. Spring 90 may for example comprise a Belleville spring pack, a pneumatic spring or a hydraulic force multiplier, or the like.

As will be apparent to those skilled in the art in light of the foregoing disclosure, many alterations and modifications are possible in the practice of this invention without departing from the spirit or scope thereof. Possible alterations and modifications include, without limitation:

The features of downhole pumps 10, 10A, and 10B may be combined in combinations other than those expressly described above, or used singly. For example, a pump substantially similar to downhole pump 10 could utilize a coil spring 46A and connecting wire 48 in place of spring wire 46, but be in all other respects identical to downhole pump 10.

Figure 6:
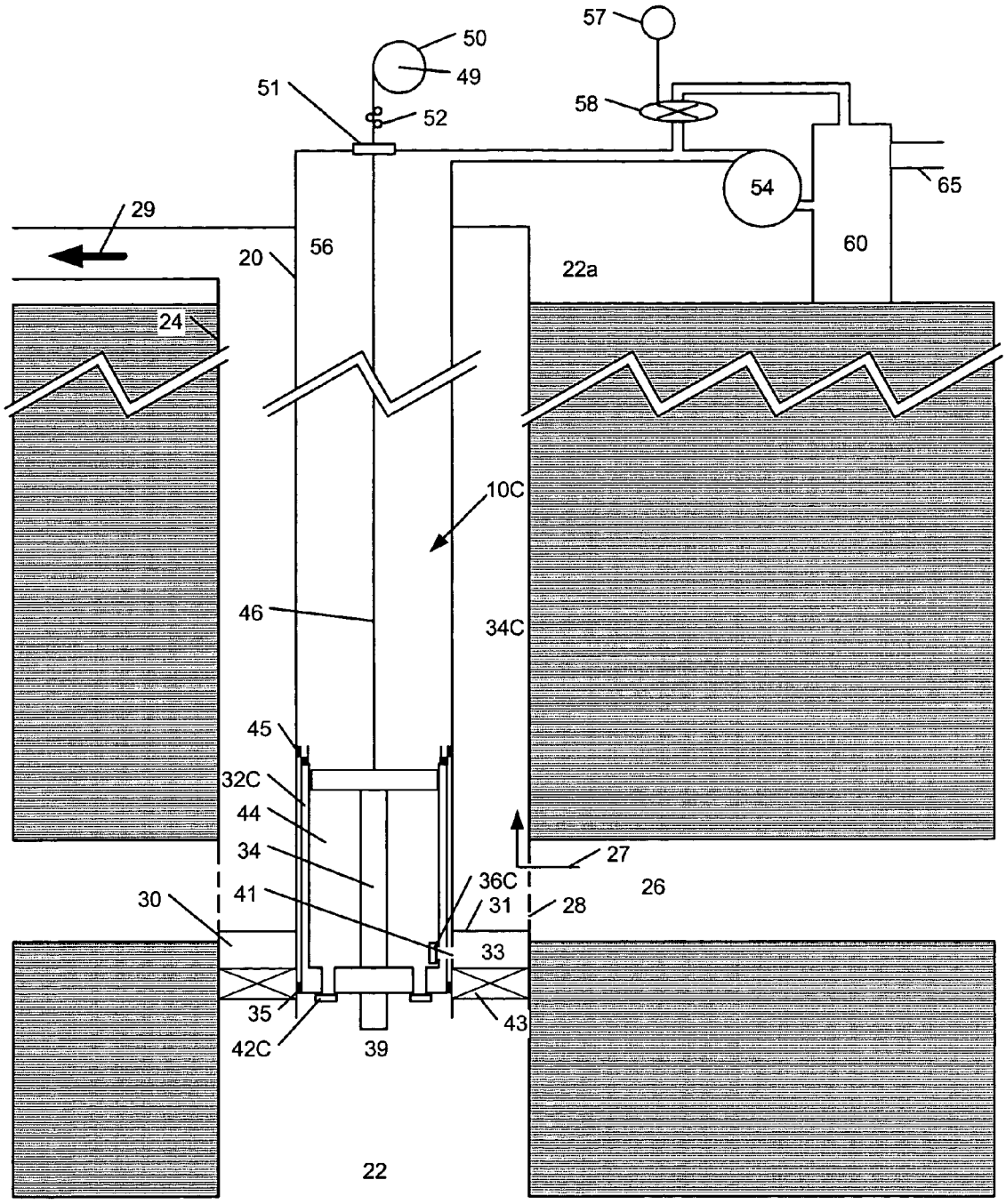
FIG. 6 is a schematic diagram of a pump representing a fourth embodiment of the invention wherein the pump is configured to pump fluid down into the well from a higher elevation within the well.

A downhole pump could be made to pump in a reverse direction. FIG. 6 shows a downhole pump 10C which has a basic structure substantially similar to that of downhole pump 10. However, at least one one-way inlet valve assembly 36C is located in cylinder assembly 32C in a path of fluid communication between pumping chamber 44 and a space 33 located in casing 24 adjacent to cylinder assembly 32C. A locking seal 45 ensures liquid is not forced upward into tubing 20 upon compression of pumping chamber 44. A standard wire line locking procedure may be used to hold cylinder assembly 32C at the correct position within well 22. Inlet valve assembly 36C allows fluid to enter pumping chamber 44 from space 33 when pumping chamber 44 is expanded by the release of pressure in column of fluid 56 and by the upward force provided by spring wire 46. A hole 41 in tubing 20 allows fluid to flow from casing 24 into tubing 20. A block 43 separates the fluid in casing 24 above the level of downhole pump 10 from the fluid in casing 24 below the level of downhole pump 10. At least one one-way outlet valve assembly 42C is located in cylinder assembly 32C, in a path of fluid communication between space 39 and pumping chamber 44. Outlet valve assembly 42C allows fluid to be expelled from pumping chamber 44 downward into gas well 22 upon the application of pressure to column of fluid 56 by pressure source 54.

Figure 7:
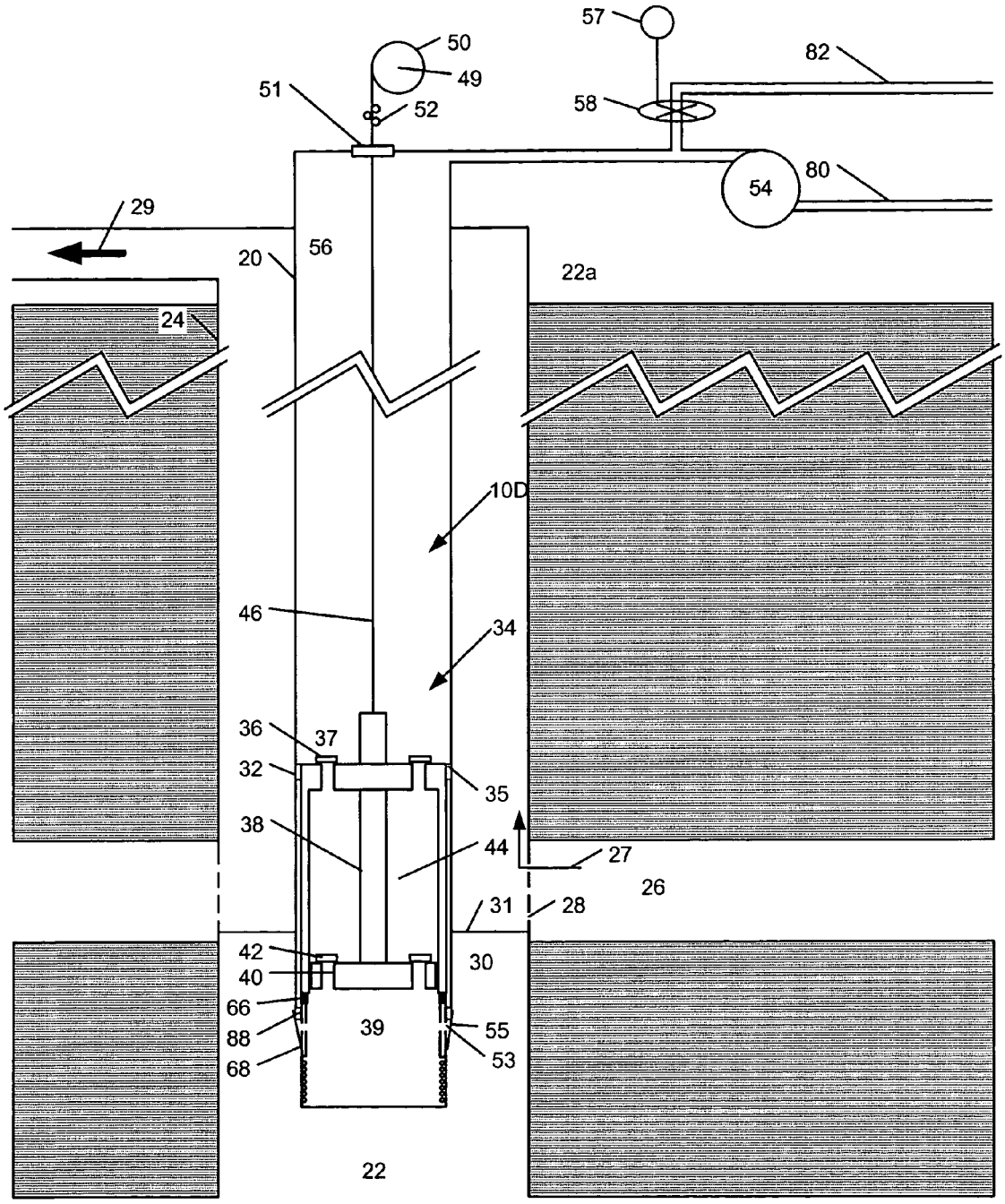
FIG. 7 is a schematic diagram of a pump according to a fifth embodiment of this invention. In this embodiment, the pump is configured to allow pumping through separate discharge and suction pipes without a fluid reservoir.

The downhole pump could utilize separate inlet and discharge pipes with no fluid reservoir. FIG. 7 shows a downhole pump 10D in which an inlet pipe 80 is used to supply fluid to pressure source 54 in order to pressurize column of fluid 56. A separate discharge pipe 82 contains control valve 58, and directly discharges fluid from the column upon the release of pressure by the control valve 58.

Figure 8:
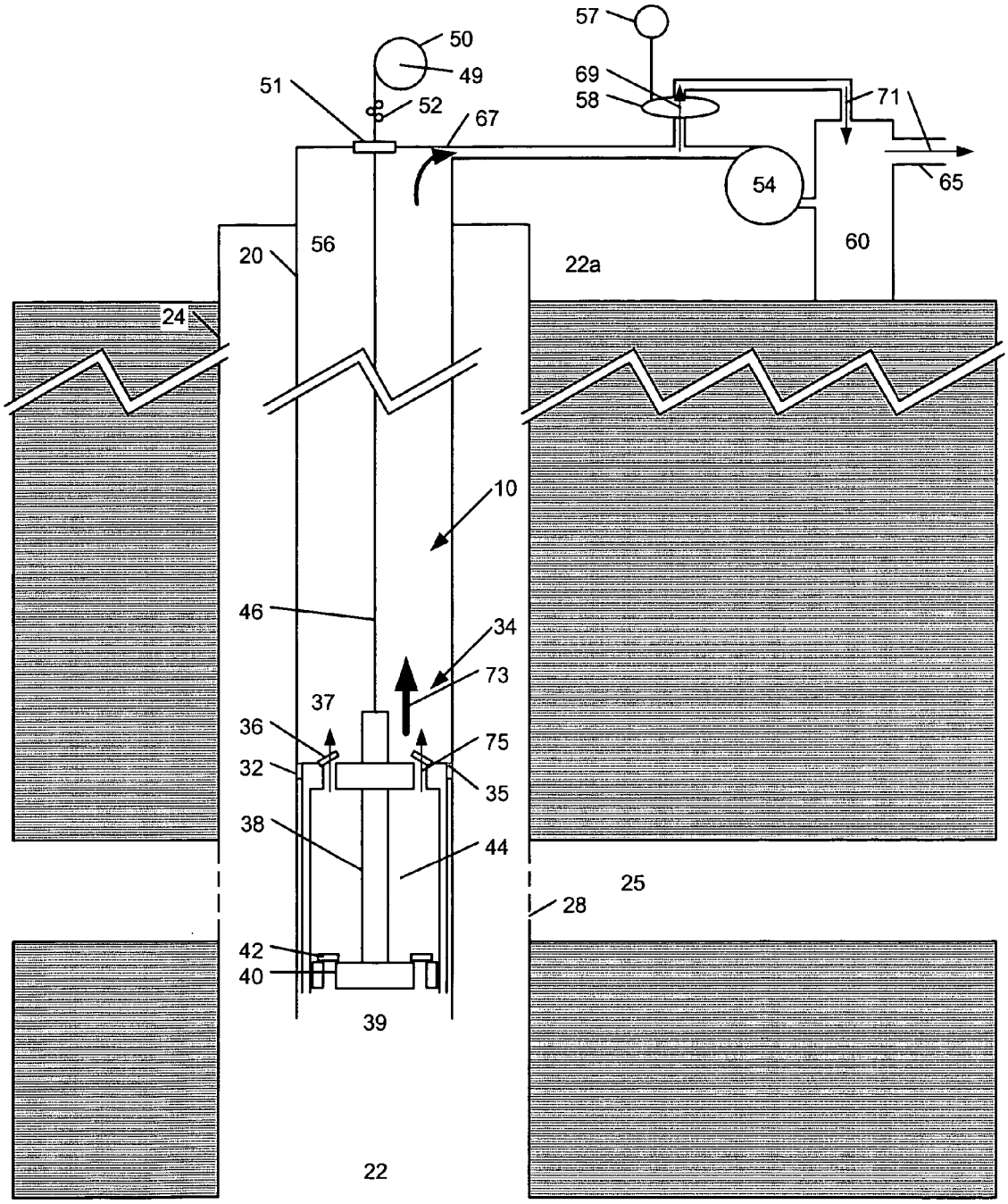
FIG. 8 is a schematic diagram of a downhole pump being used to pump oil up the tubing of an oil well.

A downhole pump according to the invention may also be used to pump production fluid up the tubing of an oil or gas well. FIG. 8 shows downhole pump 10 being used to pump oil from oil layer 25 to the surface. Oil from oil layer 25 enters casing 24 through perforations 28, and is pumped up tubing 20 in the same manner as previously described for water. Column of fluid 56 comprises the production fluid itself. Oil 25 is forced up tubing 20 by the operation of downhole pump 10, as indicated by arrow 67. Oil 25 is collected through tube 65, as indicated by arrows 69 and 71.

A downhole pump as described herein could be operated by pulling wire 46 up and down in addition to, or instead of, varying the pressure of fluid in column 56. Wire 46 may be moved up and down using any suitable mechanism at the surface of the well. For example, a drum of winch 50 could be driven by an electric motor which is operated by a suitable controller to alternately take in and let out wire 46. Other mechanisms such as a long stroke hydraulic piston or other linear actuator could be connected to alternately take in and let out an upper end of wire 46.

Accordingly, the scope of the invention is to be construed in accordance with the substance defined by the following claims.

What is claimed is:

1. A pump adapted to be used in a tubing in a well, the pump comprising:

a piston assembly reciprocably engaged in a cylinder assembly, the piston assembly comprising a first piston coupled to a second piston, the second piston having a cross-sectional area larger than a cross-sectional area of the first piston, a pumping chamber being defined by the piston assembly and the cylinder assembly, the cylinder assembly connectable to the tubing such that the first piston is in fluid communication with a bore of the tubing and the pumping chamber is in fluid communication with the bore of the tubing by way of a first one-way valve oriented to permit fluid to flow from the pumping chamber into the bore of the tubing and a first means for biasing the piston assembly in a first direction, the first means for biasing the piston assembly in a first direction extending between the piston assembly and an anchor point located outward of the piston assembly, wherein the piston assembly is movable in a second direction, which is opposite the first direction, by increasing a fluid pressure in the bore of the tubing against the first piston, the pressure being increased by introducing a first volume of fluid into a column of fluid in the bore of the tubing, and wherein a second volume of fluid is expelled from the pumping chamber into and becomes part of the column of fluid in the bore of the tubing when the piston assembly moves in the first direction, the second volume of fluid being larger than the first volume of fluid.

2. A pump according to claim 1 wherein the anchor point is located at substantially a surface of the ground.

3. A pump according to claim 1 wherein the anchor point is located above a top of a casing of the well.

4. A pump according to claim 1 wherein the first means for biasing the piston assembly in a first direction comprises an elastically stretchable wire.

5. A pump according to claim 4 wherein the elastically stretchable wire is elastically stretchable by a length of a stroke of the piston assembly.

6. A pump according to claim 5 wherein the length of the stroke is in the range of approximately 5 feet to 15 feet.

7. A pump according to claim 4 wherein the elastically stretchable wire is at least 500 feet long.

8. A pump according to claim 1 wherein the first means for biasing the piston assembly in a first direction comprises a coil spring.

9. A pump according to claim 1 wherein the first means for biasing the piston assembly in a first direction comprises a Belleville spring pack.

10. A pump according to claim 1 wherein the first direction is upward and the second direction is downward.

11. A pump according to claim 1 wherein the second piston comprises at least one second one-way valve in a path of fluid communication between the pumping chamber and a space in the tubing which is inward from the piston assembly, the at least one second one-way valve of the second piston allows fluid to flow only into the pumping chamber, and wherein the first one-way valve is in a path of fluid communication between the pumping chamber and a space in the tubing which is outward from the cylinder assembly, wherein the first one-way valve of the cylinder assembly allows fluid to flow only out of the pumping chamber to the space of the tubing which is outward from the cylinder assembly.

12. A pump according to claim 11 wherein the space in the tubing which is inward from the cylinder assembly is below the cylinder assembly and the space in the tubing which is outward from the cylinder assembly is above the cylinder assembly.

13. A pump according to claim 1 wherein the second piston comprises at least one second one-way valve in a path of fluid communication between the pumping chamber and a space in the tubing which is inward from of the cylinder assembly, and wherein the first piston comprises a hollow portion and the first one-way valve is in a path of fluid communication between the pumping chamber and a space in the tubing which is outward from the cylinder assembly, the first one-way valve of the first piston allows fluid to flow only out of the pumping chamber to the space of the tubing which is outward from the cylinder assembly, the fluid being expelled from the pumping chamber through the hollow portion.

14. A pump according to claim 13 wherein the space in the tubing which is inward from the cylinder assembly is below the cylinder assembly and the space in the tubing which is outward from the cylinder assembly is above the cylinder assembly.

15. A pump according to claim 1 comprising a second means for biasing the piston assembly in the first direction, the second means for biasing the piston assembly in the first direction extending between the piston assembly and a point inward from the piston assembly.

16. A pump according to claim 15 wherein the second means for biasing the piston assembly in the first direction comprises at least one of: a Belleville spring pack, a pneumatic spring or a hydraulic force multiplier.

17. A pump according to claim 1 wherein the anchor point is located above the piston assembly.

18. A pumping system comprising a pump according to claim 1 and means for varying the pressure of the fluid in the tubing against the first piston.

19. A pumping system according to claim 18 wherein the means for varying the pressure of the fluid against the first piston comprises a pressure source connected to introduce fluid into the tubing to increase the pressure against the first piston and a control valve in fluid communication with the tubing which may be opened to permit fluid to be removed from the tubing to decrease the pressure against the first piston.

20. A pumping system according to claim 19 wherein the pressure source comprises at least one of a pneumatic pump, a motor-driven pump, an electric pump, a high pressure pipeline or a gas compressor.

21. A pumping system according to claim 20 wherein the pressure source is located at the surface of the well.

22. A pumping system according to claim 21 wherein the pumping system is adapted for use in a gas well, and gas is permitted to flow in the well casing in the first direction.

23. A pumping system according to claim 22 wherein the pumping system is adapted to be used to dewater coal beds to facilitate extraction of coal bed methane.

24. A pumping system according to claim 18 wherein the pumping system is adapted to be used in an oil well, and a production fluid is pumped up the tubing.

25. A pumping system according to claim 21 comprising means for preventing fluid from passing from the tubing into the casing in the event that the pump fails.

26. A pumping system according to claim 18 comprising a sealing apparatus which is slidable between a first position which is open to allow fluid to enter the tubing from the well below the pump, and a second position which is closed to prevent liquid from passing from the tubing into the well below the pump, and wherein the cylinder assembly comprises a downwardly projecting member that displaces the sealing apparatus downwardly to hold the sealing apparatus in the first position during normal operation of the pump.

27. A pumping system according to claim 26 wherein the sealing apparatus comprises a spring-loaded sleeve, a spring-loaded ball or a plunger.

28. A pumping system according to claim 18 wherein the anchor point comprises an adjusting winch.

29. A pumping system according to claim 18 comprising a tension indicator connected to monitor a tension in the first means for biasing the piston assembly in a first direction.

30. A pumping system according to claim 29 wherein the tension indicator is located at the surface of the well.

31. A pumping system according to claim 19 comprising a fluid reservoir in fluid communication with the pressure source, the fluid reservoir containing fluid to be introduced into the tubing by the pressure source.

32. A pumping system according to claim 31 wherein the control valve is in fluid communication with the fluid reservoir, whereby the fluid removed from the tubing and flowing through the control valve is deposited in the fluid reservoir.

33. A pumping system according to claim 32 wherein the fluid reservoir has an outlet for removing excess fluid from the fluid reservoir.

34. A pumping system according to claim 19 comprising means for opening and closing the control valve.

35. A pumping system according to claim 34 comprising means for monitoring the pressure of the fluid in the tubing against the first piston, the means for monitoring the pressure of the fluid in the tubing against the first piston being in communication with the means for opening and closing the control valve, whereby the control valve is opened and closed according to the pressure of the fluid in the tubing against the first piston.

36. A pumping system according to claim 35 wherein the means for monitoring the pressure of the fluid in the tubing against the first piston comprises one or more of: means for monitoring the tension in the first means for biasing the piston assembly in a first direction, means for monitoring the cycle time of the pump, means for monitoring the fluid discharge rate of the pump and means for monitoring the rate of any gas flowing out of the well.

37. A pumping system according to claim 18 comprising a seal between the cylinder assembly and the tubing to prevent fluid from flowing past the cylinder assembly.

38. A pump according to claim 1 wherein the first volume of fluid is equivalent to the volume of the portion of the first piston which is displaced in the second direction during movement of the piston assembly in the second direction.

39. A pump according to claim 1 wherein the first piston, the second piston and the tubing each have a circular cross-section.

40. A pump according to claim 1 comprising a screen on a suction side of the pumping chamber, the screen disposed to block entry into the pumping chamber of solid particles larger than a size of openings in the screen.

41. A pump according to claim 1 wherein the cylinder assembly comprises a bulkhead extending across the bore;

a piston assembly mounted for reciprocation in the cylinder assembly, the piston assembly comprising a first piston slidably and sealingly disposed within a bore of the cylinder assembly and a second piston coupled to the first piston and projecting through an aperture in the bulkhead, the piston assembly defining a variable pumping volume between the first piston and the bulkhead.

42. A pumping apparatus for use in a tubing in a well, the pumping apparatus comprising a piston assembly reciprocably engaged within a cylinder assembly, means for applying a force in a first direction to the piston assembly, the means for applying a force in a first direction to the piston assembly extending between the piston assembly and an anchor point located outward from the piston assembly, means for causing a fluid pressure within the tubing against the piston assembly to vary in order to alternately apply and release a force on the piston assembly in a second direction opposite to the first direction, wherein the piston assembly is movable in the second direction by increasing the fluid pressure within the tubing by introducing a first volume of fluid into a column of fluid in the tubing, and wherein a second volume of fluid is expelled from a pumping chamber defined by the piston assembly and the cylinder assembly when the piston assembly moves in the first direction, the second volume of fluid being expelled into and becoming part of the column of fluid and being larger than the first volume of fluid.

43. A method for pumping fluid from a well, the method comprising:

providing, in a tubing in a well, a pump comprising a piston assembly reciprocably engaged in a cylinder assembly, and a first means for biasing the piston assembly in a first direction, the first means for biasing the piston assembly in a first direction extending between the piston assembly and an anchor point located outward from the piston assembly, a pumping chamber being defined by the cylinder assembly and the piston assembly, the piston assembly comprising a first piston coupled to a second piston, the second piston having a larger cross-sectional area than a cross-sectional area of the first piston, varying a fluid pressure in a bore of the tubing against the first piston by increasing the fluid pressure in the bore acting against the first piston and thereby causing the piston assembly to move in a second direction which is opposite the first direction, thereby allowing fluid to enter the pumping chamber, and reducing the fluid pressure in the bore and thereby allowing the first means for biasing the piston assembly in a first direction to move the piston assembly in the first direction to expel fluid from the pumping chamber into the bore of the tubing, wherein the fluid pressure against the first piston is increased by introducing a first volume of fluid into a column of fluid in the bore of the tubing, and a second volume of fluid is expelled from the pumping chamber into and becoming part of the column of fluid in the bore of the tubing when the piston assembly moves in the first direction, the second volume of fluid being larger than the first volume of fluid.

44. A method according to claim 43 wherein the first direction is upward and the second direction is downward.

45. A method according to claim 43 wherein the well is an oil well and the fluid pumped from the well is oil.

46. A method according to claim 43 wherein the well is a gas well, the well comprises a casing, and the gas is permitted to flow in the well casing in the first direction.

47. A method according to claim 46 wherein the fluid pumped from the well is one or more of water and hydrocarbon liquids and the method is used to dewater a coal bed and the gas is coal bed methane.

48. A method according to claim 43 comprising using the fluid pumped from the well as the fluid introduced into the tubing to increase the pressure against the first piston.

49. A method according to claim 43 comprising monitoring the pressure of the fluid in the tubing against the first piston and adjusting the pressure against the first piston in order to vary the pressure of the fluid in the tubing against the first piston.

50. A method according to claim 49 wherein monitoring the pressure of the fluid in the tubing against the first piston comprises monitoring one or more of: the tension in the first means for biasing the piston assembly in the first direction, the cycle time of the pump, the fluid discharge rate of the pump and the rate of any gas flowing out of the well.

51. A method according to claim 43 wherein the pressure of the fluid in the tubing against the first piston is reduced by opening a control valve in fluid communication with the tubing thereby permitting fluid to be removed from the tubing.

52. A method according to claim 43 wherein the first means for biasing the piston assembly in the first direction comprises an elastically stretchable wire, the method comprising monitoring and adjusting the tension and length of the wire.

53. A method according to claim 43 wherein the first piston comprises a hollow portion in fluid communication with the pumping chamber, the fluid being expelled from the pumping chamber through the hollow portion.

54. A method according to claim 43 wherein the pump comprises a second means for biasing the piston assembly in the first direction, the second means for biasing the piston assembly in the first direction extending between the piston assembly and a point distal of the piston assembly.

55. A method according to claim 43 wherein, movement of the piston assembly in the second direction causes a backflow of fluid through a screen on a suction side of the pumping chamber.

56. A method for pumping a fluid at a downhole location in a well, the method comprising:

providing a piston assembly supported for reciprocation in a cylinder assembly at the downhole location, the piston assembly comprising a larger-area piston coupled to a smaller-area piston, the smaller-area piston extending through an aperture in a bulkhead of the cylinder assembly;

causing the piston assembly to move in an inward direction in the well by increasing a fluid pressure on an outward side of the piston assembly by introducing a first volume of fluid into a column of fluid in a bore of a tubing above the bulkhead of the cylinder assembly;

as the piston assembly moves in the inward direction, storing energy in an extendable member coupled between the piston assembly and an anchor located outward of the piston assembly; and reducing the fluid pressure on the outward side of the piston assembly and allowing the stored energy in the extendable member to pull the piston assembly in an outward direction; wherein, the larger-area piston moves toward the bulkhead when the piston assembly moves in one of the inward and outward directions and, in moving toward the bulkhead, the larger-area piston forces a second volume of fluid through a one-way mechanism into the column of fluid in the bore of the tubing such that the second volume of fluid becomes part of the column of fluid in the bore of the tubing, the second volume of fluid being larger than the first volume of fluid.

57. A method according to claim 56 wherein causing the piston assembly to move in the inward direction comprises causing the larger-area piston to move toward the bulkhead to pump fluid into the well.

58. A method according to claim 56 wherein allowing the extendable member to pull the piston assembly in the outward direction comprises allowing the larger-area piston to move toward the bulkhead to pump fluid out of the well.

59. A pump adapted to be used in a tubing in a well, the pump comprising:

a piston assembly reciprocably engaged in a cylinder assembly, the piston assembly comprising a first piston coupled to a second piston, the second piston having a cross-sectional area larger than a cross-sectional area of the first piston, a pumping chamber being defined by the second piston and the cylinder assembly, and an elastically extendable member connected between the piston assembly and an anchor point located above the piston assembly, the elastically extendable member biasing the piston assembly in a first direction, wherein the piston assembly is movable in a second direction, which is opposite the first direction, by increasing a fluid pressure in a bore of the tubing against the first piston, the pressure being increased by introducing a first volume of fluid into a column of fluid in the bore of the tubing, and wherein a second volume of fluid is expelled from the pumping chamber into and becomes part of the column of fluid in the bore of the tubing when the piston assembly moves in the first direction, the second volume of fluid being larger than the first volume of fluid.

60. A pump according to claim 59 wherein the elastically extendable member comprises a wire and the anchor point is substantially at or above a surface of the ground.

61. A pump according to claim 59 wherein the wire comprises a stainless steel wire.

* * * * *